US005178513A

United States Patent [19]

Trommer et al.

[11] Patent Number: 5,178,513

[45] Date of Patent: Jan. 12, 1993

[54] TURBINE NOZZLE PHASING DEVICE

[75] Inventors: William C. Trommer; Gary D. Nohr, both of Rockford, Ill.

[73] Assignee: Sundstrand Corporation, Rockford, Ill.

[21] Appl. No.: 774,520

[22] Filed: Oct. 8, 1991

[51] Int. Cl.[5] ..... F01D 17/00

[52] U.S. Cl. ..... 415/13; 415/9; 415/150; 415/156; 415/157; 239/309

[58] Field of Search ..... 415/9, 13, 29, 36, 41, 415/42, 44, 49, 148, 150, 151, 156, 157, 167; 60/39.25; 114/20.2; 239/309, 562

[56] References Cited

U.S. PATENT DOCUMENTS

| | | | |
|---|---|---|---|
| 952,792 | 3/1910 | Ehrhart | 415/44 |
| 984,493 | 2/1911 | Roth | 415/49 |
| 2,974,619 | 3/1961 | Bombl et al. . | |
| 3,045,624 | 7/1962 | Daley et al. . | |
| 3,417,719 | 12/1968 | Nitenson . | |
| 3,856,185 | 12/1974 | Riccio | 239/309 |
| 3,990,230 | 11/1976 | Kuwashima et al. . | |
| 4,145,875 | 3/1979 | Liddle et al. . | |
| 4,648,242 | 3/1987 | Griesinger . | |
| 4,648,322 | 3/1987 | Heitz et al. . | |
| 4,672,806 | 6/1987 | Pisano . | |
| 4,824,024 | 4/1989 | Bishop et al. | 239/562 |
| 4,909,028 | 3/1990 | Cetrelli et al. | 60/39.25 |

*Primary Examiner*—Edward K. Look
*Assistant Examiner*—Christopher M. Verdier
*Attorney, Agent, or Firm*—Antonelli, Terry, Stout & Kraus

[57] ABSTRACT

Turbine nozzle phasing device for controlling a flow of gasses to a plurality of nozzles in response to a control signal. The turbine nozzle phasing device includes a housing having a lower portion which includes a first plenum for receiving the flow of hot gasses and an upper portion which includes a second plenum integral with the first plenum, a detachable partition for separating the first plenum from the second plenum and a first nozzle which communicates with the first plenum. Hot gasses flowing into the first plenum flows through the first nozzle. A set of second nozzles is provided which communicates with the second plenum. Partition detaching apparatus is also included for detaching the detachable partition in response to the control signal to permit a portion of the hot gasses flowing into the first plenum to flow into the second plenum and through the set of second nozzles.

20 Claims, 2 Drawing Sheets

TURBINE NOZZLE PHASING DEVICE

TECHNICAL FIELD

The present invention relates to apparatus for controlling the flow of hot gasses in response to a control signal. More particularly, the present invention relates to a turbine nozzle phasing device for discretely phasing the flow of hot gases to a plurality of nozzles in a turbine engine in response to a control signal.

BACKGROUND ART

A turbine type combustion engine generates hot gasses which are directed by nozzles to turn turbine wheel(s) in the turbine engine. The wheel(s) of the turbine engine are coupled to mechanical apparatus to cause movement thereof.

Such a turbine engine may also be used, for example, in torpedoes wherein a propellant is provided to generate hot gasses for driving the wheel(s) of the turbine engine. The wheel(s) of the turbine engine are coupled to the shaft of the propeller of the torpedo, thereby rotating the propeller through the shaft so as to propel the torpedo.

The turbine engine of a torpedo operates with a fixed amount of propellant which is ignited to generate the hot gasses for turning the wheel(s) of the turbine engine. Most torpedoes, whether launched from a submarine or air, run at a medium speed range which is called the search mode for the majority of a run and upon acquisition of the target goes to a high speed range for the duration of the run. In order to maximize the range of the torpedo and/or increase the search mode time, it is necessary that the efficiency of the turbine engine be maintained at a high level at both the medium speed and the high speed ranges.

Turbine engines for torpedoes are generally designed for maximum efficiency corresponding to the high speed because the largest amount of fuel is consumed at the high speed. Maintaining high efficiency in the turbine engine at both the medium speed and the high speed ranges requires maintaining the pressure ratio across the nozzle(s) of the turbine engine at approximately the same level at both the medium speed and high speed ranges. Switching from the medium speed range to the high speed range requires an increase in the flow of hot gases through the nozzle(s) to cause the wheel(s) of the turbine engine to rotate at a faster rate. This increase in the flow of hot gases through the nozzle(s) causes an increase in the pressure ratio across the nozzle(s). A lower efficiency results when operating at the lower pressure ratios of the medium speed range. This decrease in the pressure ratio occurs because when the turbine engine is operated at the medium speed range the decrease in the flow of hot gasses causes a decrease in pressure at the inlet.

Various torpedo control systems and control systems for controlling turbines are known in the art. However, none of the systems address the problem of maintaining high efficiency in the turbine by maintaining the same pressure ratio across the nozzles of the turbine at all speed ranges.

For example, U.S. Pat. No. 2,974,619 discloses a fluid control system for controlling the operation of combustion apparatus in the firing cycle of a torpedo. Particularly, U.S. Pat. No. 2,974,619 discloses a fluid control system for controlling the introduction of combustion materials to prevent pre-ignition and to ensure ignition at the proper time.

The apparatus disclosed by U.S. Pat. No. 2,974,619 does not address the problems associated with maintaining high efficiency in a turbine engine by maintaining the same pressure ratio across the nozzles at all speed ranges.

U.S Pat. No. 3,045,624 discloses a speed change system for use in torpedoes of the type propelled by an electric battery source of energy.

U.S. Pat. No. 3,045,624 is not directed to torpedoes powered by a turbine engine. Further U.S. Pat. No. 3,045,624 does not address the problems associated with maintaining high efficiency in a turbine engine by maintaining the same pressure ratio across the nozzles at all speed ranges.

U.S Pat. No. 3,417,719 discloses adaptor apparatus for an underwater projectile for precisely propelling the projectile along a predetermined path by permitting a stream of gasses to flow from the casing of the projectile.

U.S Pat. No. 3,417,719 is not directed to turbine engines. Therefore, U.S. Pat. No. 3,417,719 does not address the problems associated with maintaining high efficiency in a turbine engine by maintaining the same pressure ratio across the nozzles at all speed ranges.

U.S Pat. No. 3,990,230 discloses a method for controlling a steam turbine in a composite plant equipped with steam and gas turbines wherein steam produced by utilizing exhaust gas from the gas turbine is controlled according to the speed of the steam turbine and the condition of the steam fed to the steam turbine.

U.S. Pat. No. 3,990,230 although directed to improvements in the operation of turbine engines does not address the problems associated with maintaining high efficiency in a gas turbine by maintaining the same pressure ratio across the nozzles at all speed ranges.

U.S. Pat. No. 4,145,875 discloses apparatus for improving the rate of gas flow in gas turbine engines, turbo chargers or superchargers by providing individual gate elements reciprocally mounted to open and close separate divergent diffuser passages for centrifugal compressors or radial inflow turbine nozzle assemblies.

U.S Pat. No. 4,145,875 although directed to improving the fuel economy of a gas turbine engine does not adequately address all the issues related to improving the efficiency of a turbine engine by maintaining the same pressure ratio across the nozzles at all speed ranges.

U.S. Pat. No. 4,648,242 discloses apparatus used for controlling the function of a fuel powered turbine engine by providing a constant fuel consumption rate.

Although U.S. Pat. No. 4,648,242 is directed to improving the efficiency of a turbine engine, U.S. Pat. No. 4,648,242 does not adequately address all the issues related to improving the efficiency of a turbine engine by maintaining the same pressure ratio across the nozzles at all speed ranges.

U.S. Pat. No. 4,648,322 discloses a propulsion and directional control mechanism for an underwater device such as torpedo. U.S. Pat. No. 4,648,322 makes use of a gas turbine engine for the propulsion system.

Although U.S. Pat. No. 4,648,322 is directed to improvements in the turbine engine and the directional control mechanism U.S. Pat. No. 4,648,322 does not adequately address all the issues related to improving the efficiency of a turbine engine by maintaining the same pressure ratio across the nozzles at all speed ranges.

U.S. Pat. No. 4,672,806 discloses turbine engine fuel control apparatus for regulating the amount of fuel supplied to the turbine engine in response to parameters which include engine acceleration U.S. Pat. No. 4,672,806 regulates the amount of fuel supplied to the turbine engine by electrical apparatus which outputs an electrical signal which controls the appropriate value in the system.

U.S. Pat. No. 4,672,806 does not address the problems associated with improving the efficiency of a turbine engine by maintaining the same pressure ratio across the nozzles at all speed ranges.

DISCLOSURE OF INVENTION

The apparatus of the present invention addresses the problems associated with improving the efficiency of a turbine engine by maintaining the pressure ratio across the nozzles at the same level by providing a turbine nozzle phasing device for controlling the flow of hot gasses to the nozzles at two discrete speeds in response to a control signal.

The apparatus of the present invention maintains high efficiency operation of a turbine engine by maintaining the same pressure ratio across the nozzles of the turbine engine during medium and high speed ranges by increasing the nozzle effective area of the turbine engine from an initial value to a predetermined higher value when the turbine engine is switched from the medium speed range to the high speed range.

Particularly, the apparatus of the present invention provides a turbine nozzle phasing device for controlling the flow of hot gasses to the nozzles of the turbine engine in response to a control signal which indicates when the turbine is switched from operation at a medium speed range to a high speed range.

Further, the apparatus of the present invention provides a turbine nozzle phasing device which allows for an increase in the nozzle effective area at a specified time so that the pressure ratio across the nozzles can be maintained at the same level in at least two different turbine speed ranges.

Still further, the apparatus of the present invention provides a turbine nozzle phasing device which minimizes the fuel consumption of the turbine engine by allowing for an increase in the arc of admission at a specified time so that the pressure ratio across the nozzles can be maintained at the same level at two different turbine speed ranges.

Still further yet, the apparatus of the present invention provides a turbine nozzle phasing device which operates, for example, with the turbine engine of a torpedo for maximizing the range of the torpedo and/or increasing the search mode time of the torpedo by improving the efficiency of the turbine engine to operate at two different speed ranges with minimal fuel consumption.

The turbine nozzle phasing device of the present invention controls the flow of hot gases to a plurality of nozzles in response to a control signal which may, for example, indicate when the turbine engine is switched from operating at a medium speed range to a high speed range.

The turbine nozzle phasing device of the present invention includes a housing having a lower portion which includes a first plenum for receiving a flow of hot gasses and an upper portion which includes a second plenum integral with the first plenum, and a detachable partition for separating the first plenum of the lower portion of the housing from the second plenum of the upper portion of the housing.

The turbine nozzle phasing device also includes a first nozzle which communicates with the first plenum wherein the flow of hot gasses flowing into the first plenum flows through the first nozzle and at least a second nozzle which communicates with the second plenum. In the present invention in order to maintain high efficiency operation of the turbine at the medium speed range hot gasses are caused to flow through the first nozzle to maintain the pressure ratio across the nozzle at a high level. The pressure ratio is the ratio of a pressure at a point in the first plenum prior to the inlet of the first nozzle to a pressure at a point at the outlet of the first nozzle but prior to the turbine wheel(s) of the turbine.

In the present invention high efficiency operation of the turbine engine is maintained by maintaining the pressure ratio at the same level for all speed ranges. This is accomplished in the apparatus of the present invention by phasing in the second nozzle(s) when the turbine engine is switched from the medium speed range to the high speed range, thereby increasing the nozzle effective area of the turbine engine.

Partition detaching apparatus is provided in the turbine nozzle phasing device of the present invention for severing the detachable partition in response to a control signal to permit a portion of the flow of hot gasses flowing into the first plenum to flow into the second plenum and through the second nozzle(s), thereby phasing in the second nozzle(s) through which a portion of the hot gasses are permitted to flow.

The partition detaching apparatus includes a plunger for striking the detachable partition and severing the detachable partition and pyrotechnic apparatus including a pyrotechnic chamber and charge which when ignited propels the plunger to strike the detachable partition thereby detaching the detachable partition.

The control signal is provided to the pyrotechnic charge of the pyrotechnic apparatus through an electrical connector attached to the pyrotechnic apparatus. The plunger includes a cutter head for severing the detachable partition from the inside surfaces of the housing.

The detachable partition is concave relative to the first plenum to improve the capability of the first plenum as a pressure vessel.

The turbine nozzle phasing device provides an anvil disposed in the first plenum of the lower portion of the housing for trapping the detached detachable partition between the anvil and the plunger. Trapping the detached detachable partition is important to prevent it from being swept away by the flow of hot gasses and possibly blocking one of the nozzles. The anvil is held by a support ring attached to the inner surfaces of the first plenum. The support ring includes a plurality of flow passages which permit hot gasses to flow past the anvil into the first plenum and through the first nozzle.

The plunger is firmly held in interference fit in the housing. Thus, the plunger is firmly held in an unactuated position before ignition of the pyrotechnic charge and in an actuated position after ignition of the pyrotechnic charge.

BRIEF DESCRIPTION OF THE DRAWINGS

The features of the present invention which are believed to be novel are set forth with particularity in the appended claims. The invention may be best understood, however, by reference to the following description in conjunction with the accompanying drawings in which:

BEST MODE FOR CARRYING OUT THE INVENTION

The present invention is being described in the present application as being used with the turbine engine of a torpedo. However, the turbine nozzle phasing device of the present invention may be used in any other application with a turbine engine which requires the turbine engine to operate at high efficiency in all speed ranges.

Figure 1:
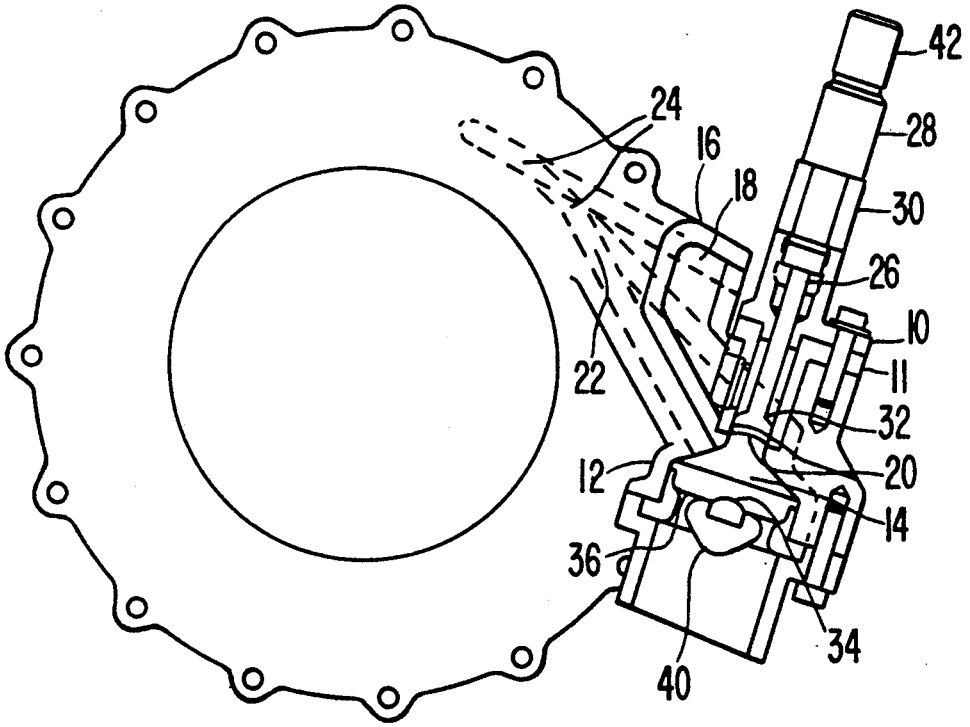
FIG. 1 illustrates the turbine nozzle phasing device of the present invention.

FIG. 1 of the present invention illustrates the turbine nozzle phasing device of the present invention being used in conjunction with the hot gas inlet of a turbine engine.

The turbine nozzle phasing device of the present invention includes a housing 10 including a lower portion 12 which includes a first plenum 14 and an upper portion 16 which includes a second plenum 18 integral with the first plenum 14.

A detachable partition 20 is disposed in the interior of the housing 10 integral with the inner surfaces 11 of the housing 10 The partition is detachable and serves to separate the first plenum 14 of the lower portion 12 of the housing 10 from the second plenum 18 of the upper portion 16 of the housing.

A first nozzle 22 is provided in the turbine nozzle phasing device of the present invention. The first nozzle 22 communicates with the first plenum 14. Hot gasses flowing into the first plenum 14 flow through the inlet of the first nozzle 22. Hot gasses exiting from the outlet of the first nozzle 22 turn the blades of the wheel(s) (not shown) of the turbine engine associated with the turbine nozzle phasing device. The turbine wheel(s) is coupled to the shaft of the propeller of the torpedo (not shown). Hot gasses exiting from the first nozzle 22 turns the wheel(s) of the turbine engine at a rate which causes the torpedo to move at the medium speed range. The medium speed range is known as the search mode which allows the torpedo to operate at a low fuel consumption rate until acquisition of the target. In order to maintain high efficiency operation of the turbine engine in the medium speed range hot gasses are supplied to the first nozzle 22 in such a manner such that the pressure ratio across the first nozzle 22 is maintained at a high level. The pressure ratio is the ratio of a pressure at a point in the first plenum 14 prior to the inlet of the first nozzle 22 to a pressure at a point at the outlet of the first nozzle 22 prior to the turbine wheel(s) of the turbine.

A set of second nozzles 24 is provided in the turbine nozzle phasing device of the present invention. The set of second nozzles 24 communicates with the second plenum 18. The second set of nozzles 24 when phased in is designed to increase the nozzle effective area of the turbine engine thereby permitting more hot gasses to flow into the turbine engine to turn the wheel(s) of the turbine engine at a rate so that the torpedo operates at the high speed range across the nozzles while also maintaining the pressure ratio at a level same as in the medium speed range.

In order to increase the speed of the torpedo from the medium speed range to the high speed range a corresponding increase in the flow of hot gasses across the turbine wheel(s) must occur so as to turn the turbine wheel(s) at a faster rate. An increase in the amount of hot gasses flowing to the first nozzle 22 tends to build up at the inlet of the first nozzle 22 thereby causing an increase in pressure at that point. An increase in pressure at the inlet of the first nozzle causes a decrease in the pressure ratio thereby reducing the efficiency of the turbine engine. The apparatus of the present invention maintains efficiency in the operation of the turbine engine by maintaining the pressure ratio at the same level for both the medium speed range and the high speed range. This is accomplished in the apparatus of the present invention by increasing the nozzle effective area of the turbine by phasing in the set of second nozzles 24. Phasing in the set of second nozzles permits a portion of the hot gasses flowing into the first plenum 14 to flow into the second plenum 18 and through the set of second nozzles 24. To permit hot gasses to flow from the first plenum 14 to the second plenum 18 the detachable partition 20 must be removed.

Partition detaching apparatus is provided for detaching the detachable partition to permit a portion of the hot gasses flowing into the first plenum 14 to flow into the second plenum 18 and through the set of second nozzles 24.

The partition detaching apparatus includes a knife edge plunger 26 for striking and severing the detachable partition 20 from the inner surfaces of the housing 11 and pyrotechnic apparatus 28 and 30 for propelling the plunger 26 to strike the detachable partition 20 thereby detaching the detachable partition from the inner surfaces of the housing 11.

The pyrotechnic apparatus includes a pyrotechnic charge 28 and a chamber 30. The pyrotechnic charge is ignited by an electrical signal which will be described below causing the pyrotechnic charge to release explosive energy in the chamber 30. The explosive energy in the chamber 30 propels the plunger 26 to strike the detachable partition 20.

The plunger 26 includes a cutter head 32 which aids in severing the detachable partition 20 from the inner surfaces of the housing 11. The plunger 26 is held by interference fit in a non-actuated position in the housing 10.

Figure 2:
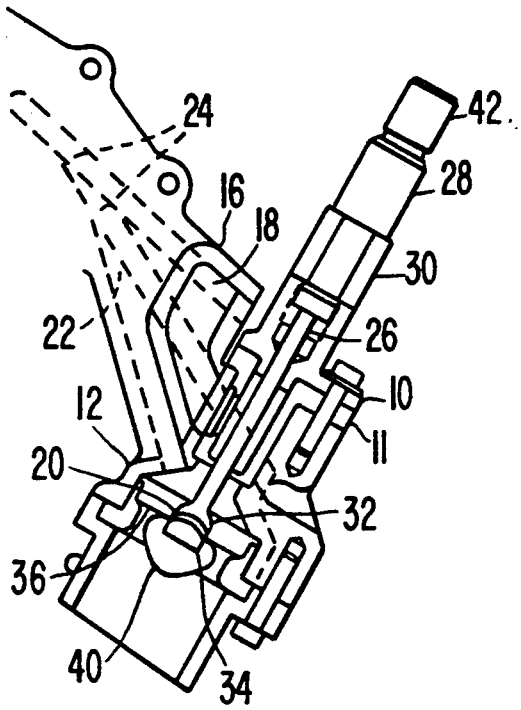
FIG. 2 illustrates a turbine nozzle phasing device of the present invention after ignition of the pyrotechnic charge.

Detachment of the partition 20 by severing causes hot gasses flowing into the first plenum 14 to flow into the second plenum 18 and through the set of second nozzles 24. FIG. 2 illustrates the turbine nozzle phasing device of the present invention when the plunger 26 is propelled to an actuated position after ignition of the pyrotechnic charge of the pyrotechnic apparatus. The plunger 26 is held by interference fit in the actuated position in the housing 10.

An anvil 34 is disposed in the lower portion 12 of the housing 10 integral with the inner surfaces of the lower portion 12 of the housing. The anvil 34 is used for trapping the detached detachable partition 20 between the anvil 34 and the cutter head 32 of the plunger 26 once the detachable partition 20 has been severed from the inner surfaces of the housing 10.

Figure 3:
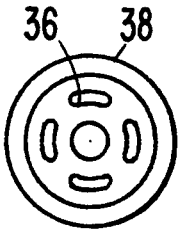
FIG. 3 illustrates a support ring of the present invention having flow passages.

The anvil 34 is supported by a support ring 36 which holds the anvil 34 in a fixed position in the lower portion 12 of the housing 10. A more detailed view of the support ring 26 is shown in FIG. 3. As shown in FIG. 3 support ring 36 for supporting the anvil 34 includes a plurality of flow passages 38 for permitting hot gasses to flow into the first plenum 14. The flow passages 38 are kidney shaped and are of a collectively sufficient flow area to minimize any undesirable changes in pressure in the hot gasses flowing into the first plenum 14. A bullet shaped structure 40 is also provided on the anvil 34 for guiding the hot gases into the flow passages 38 of the support ring 36.

The interference fit between the plunger 26 and the housing 10 causes the plunger 26 to remain in the actuated position so as not to interfere with the flow of hot gases and to hold the detachable portion 20 in the trapped position between the cutter head 32 and the anvil 34 to prevent the detachable portion 20 from being swept away by the flow of hot gasses and causing undesirable blockage of hot gas flow.

The turbine nozzle phasing device of the present invention can operate with any number of nozzles which would accomplish the desired effect of increasing the arc of admission at a specified time so that the pressure ratio across the nozzles can be maintained at the same level for all speed ranges thereby minimizing fuel consumption.

The electrical signal which controls the time at which the arc of admission is to increase is provided to an electrical connector 42 which supplies the electrical signal to the pyrotechnic charge 28 for ignition thereof.

The electrical signal may be a control signal which indicates when the turbine engine is to be switched from operation at the medium speed range to operation at the high speed range. The electrical signal controls the flow of hot gasses to the nozzles of a turbine engine so as to improve the efficiency of the turbine engine.

While the present invention has been described in terms of its preferred embodiments it should be understood numerous modifications may be made thereto without departing from the spirit and scope of the invention as defined in the appended claims. For example, the present invention may be used in any application which requires an efficiently operated turbine engine by maintaining the pressure ratio across the nozzles of the turbine engine at a high level. It is intended that all such modifications fall within the scope of the appended claims.

We claim:

1. A turbine nozzle phasing device for controlling a flow of hot gasses to a plurality of nozzles in response to a control signal, comprising:

a housing having a lower portion which includes a first plenum for receiving said flow of hot gasses and an upper portion which includes a second plenum integral with said first plenum;

a detachable partition, disposed in said housing and integral with inner surfaces of said housing, for separating said first plenum of said lower portion of said housing from said second plenum of said upper portion of said housing;

a first nozzle which communicates with said first plenum, wherein hot gasses flowing into said first plenum flow through said first nozzle;

a set of second nozzles which communicates with said second plenum; and partition detaching apparatus for detaching said detachable partition in response to said control signal to permit a portion of said hot gasses flowing into said first plenum to flow into said second plenum and through said set of second nozzles.

2. The turbine nozzle phasing device according to claim 1, wherein said partition detaching apparatus comprises:

a plunger for striking said detachable partition and severing said detachable partition from the inner surface of said housing; and pyrotechnic apparatus for igniting in response to said control signal and propelling said plunger to strike said detachable partition, thereby causing said plunger to sever said detachable partition from the inner surface of said housing.

3. The turbine nozzle phasing device according to claim 2, wherein said pyrotechnic apparatus comprises:

a pyrotechnic charge ignited in response to said control signal; and a chamber for receiving explosive energy from ignition of said pyrotechnic charge.

4. The turbine nozzle phasing device according to claim 2, wherein said plunger includes a cutter head for severing said detachable partition from the inner surface of said housing.

5. The turbine nozzle phasing device according to claim 3, wherein said plunger includes a cutter head for severing said detachable partition from the inner surface of said housing.

6. The turbine nozzle phasing device according to claim 1 further comprising:

an anvil, disposed in said lower portion of said housing and integral with the inner surface of said housing, for trapping said detachable partition, when detached from the inner surface of said housing, between said anvil and s id partition detaching apparatus.

7. The turbine nozzle phasing device according to claim 2 further comprising:

an anvil, disposed in said lower portion of said housing and integral with the inner surface of the housing, for trapping said detachable partition, when detached from the inner surface of said housing, between said anvil and said plunger.

8. The turbine nozzle phasing device according to claim 5 further comprising:

an anvil, disposed in said lower portion of said housing and integral with the inner surface of said housing, for trapping said detachable partition, when detached from the inner surface of said housing, between said anvil and said plunger.

9. The turbine nozzle phasing device according to claim 6, wherein said anvil is disposed in said lower portion of said housing by a support ring integral with the inner surface of said housing.

10. The turbine nozzle phasing device according to claim 7, wherein aid anvil is disposed in said lower portion of said housing by a support ring integral with the inner surface of said housing.

11. The turbine nozzle having device according to claim 8, wherein said anvil is disposed in said lower portion of said housing by a support ring integral with the inner surface of said housing.

12. The turbine nozzle phasing device according to claim 9, wherein said support ring includes flow passages for permitting hot gasses to flow into said first plenum.

13. The turbine nozzle phasing device according to claim 10, wherein said support ring includes flow passages for permitting hot gasses to flow into said first plenum.

14. The turbine nozzle phasing device according to claim 11, wherein said support ring includes flow passages for permitting hot gasses to flow into said first plenum.

15. The turbine nozzle phasing device according to claim 2, Wherein said plunger is held in interference fit with said housing at a non-actuated position before detaching said detachable partition and an actuated position after detaching said detachable partition.

16. The turbine nozzle phasing device according to claim 4, wherein said plunger is held in interference fit with said housing at a non-actuated position before detaching said detachable partition and an actuated position after detaching said detachable partition.

17. The turbine nozzle phasing device according to claim 5, wherein said plunger is held in interference fit with said housing in a non-actuated position before detaching said detachable partition and an actuated position after detaching said detachable partition.

18. The turbine nozzle phasing device according to claim 11, wherein said plunger is held in an interference fit with said housing in a non-actuated position before detaching said detachable partition and an actuated position after detaching said detachable partition.

19. The turbine nozzle phasing device according to claim 6, wherein said anvil includes a bullet shaped structure formed thereon for guiding hot gasses past said anvil.

20. The turbine nozzle phasing device according to claim 14, wherein said anvil includes a bullet shaped structure formed thereon for guiding hot gasses to said flow passages.

* * * * *